United States Patent [19]

Steiner

[11] 4,317,462

[45] Mar. 2, 1982

[54] AID FOR HAIRDRESSERS

[75] Inventor: Nicolas D. Steiner, London, England

[73] Assignee: Steiner Products Limited, London, Great Britain

[21] Appl. No.: 167,762

[22] Filed: Jul. 14, 1980

[30] Foreign Application Priority Data

Jun. 5, 1980 [GB] United Kingdom ..... 18496/80

[51] Int. Cl.[3] ..... A45D 24/36

[52] U.S. Cl. ..... 132/45 R; 434/94

[58] Field of Search ..... 132/9, 45 R; 434/94, 434/377

[56] References Cited

U.S. PATENT DOCUMENTS

| | | | |
|---|---|---|---|
| 2,727,522 | 12/1955 | Gomme | 132/45 R |
| 2,781,048 | 2/1957 | Le Donne | 132/45 R |
| 2,808,840 | 10/1957 | De Santis | 132/45 R |
| 3,101,557 | 8/1963 | Watlington et al. | 434/94 |

*Primary Examiner*—Robert Peshock

*Assistant Examiner*—Mickey Yu

*Attorney, Agent, or Firm*—Mason, Fenwick & Lawrence

[57] ABSTRACT

An aid for hairdressers comprises a model scalp, a set of sheets each of which is in use attached along one edge to the scalp and means indicating the location on the scalp at which each sheet is to be attached. When correctly attached to the scalp each sheet has a free edge opposite the edge attached to the scalp showing the line along which hair should be cut.

11 Claims, 3 Drawing Figures

AID FOR HAIRDRESSERS

This invention relates to an aid for hairdressers.

There are a great many hair styles from which a customer of a hairdresser may wish to choose at any particular time and it is necessary therefore for the hairdresser to be familiar with cutting these styles. However, since fashions change frequently it is constantly necessary for hairdressers to learn new styles and also for trainee hairdressers to learn both new and old styles. While it is possible for one hairdresser to demonstrate to another how to cut hair to a particular style, this is not always a convenient way of teaching a new style since teacher and pupil must be at the same location. Where such demonstrations are not possible photographs or sketches of a particular style can be sent to hairdressers illustrating a hairstyle from various viewpoints, or at greater expense a video film could be sent. Films, photographs and sketches inevitably give only a two dimensional view of a hair style and if a film is made or an elaborate series of photographs taken, such aids could prove too expensive.

It is an object of the invention to provide an aid for hairdressers which facilitates learning how to cut a particular hair style.

According to the invention an aid for hairdressers comprises a model scalp, a set of sheets, each for attachment along one edge to the scalp, and means indicating the location on the scalp at which each sheet is to be attached, wherein each sheet, when correctly attached to the scalp, has a free edge opposite the edge attached to the scalp showing the line along which hair should be cut.

The aid therefore provides a hairdresser with a three dimensional representation of how to cut a particular hairstyle. For each hairstyle a respective set of sheets is provided and in order to show a hairdresser how to cut another hairstyle all that is required is to provide another set of sheets. The sheets may be provided in blank form to be cut out along lines indicated on the blank. Thus the marginal cost of teaching a new hairstyle is very small.

The indicating means may include markings on the sheets indicating where on the scalp the sheets are to be located. The scalp may also me marked to facilitate indication of the location of the sheets. For example, the indicating means may comprise a multiplicity of indices designating respective areas of the scalp and information on each sheet indicating over which areas of the scalp said one edge of the respective sheet should be attached. The information may consist of a respective index at each end of the edge of the sheet corresponding to a particular index on the scalp at which the respective end of the sheet is to be attached. The indices may be numbers. To facilitate matching of indices different areas of the scalp may be differently coloured and the sheets may be coloured to correspond to the area of the scalp to which they are to be fixed.

The sheets are preferably of such a stiffness that when attached at one edge to the scalp they project outwardly from the scalp, but alternatively they may be floppy so that they lie over the surface of the scalp.

According to another aspect of the invention there is provided an aid for hairdressers comprising a set of sheets, each for attachment along one edge to a model scalp, each sheet including indicating means to indicate the location on the scalp at which the sheet is to be attached and wherein the edge opposite said one edge shows the line along which hair should be cut.

According to yet another aspect of the invention there is provided an aid for hairdressers comprising at least one blank with lines marked thereon to define a set of sheets, each for attachment along one edge to a model scalp, said at least one blank including indicating means to indicate the location on the scalp at which each sheet is to be attached and wherein an edge of each sheet opposite the edge to be attached to the model scalp shows the line along which hair should be cut.

By way of example an illustrative embodiment of the invention will now be described with reference to the schematic drawings, of which:

Figure 1:
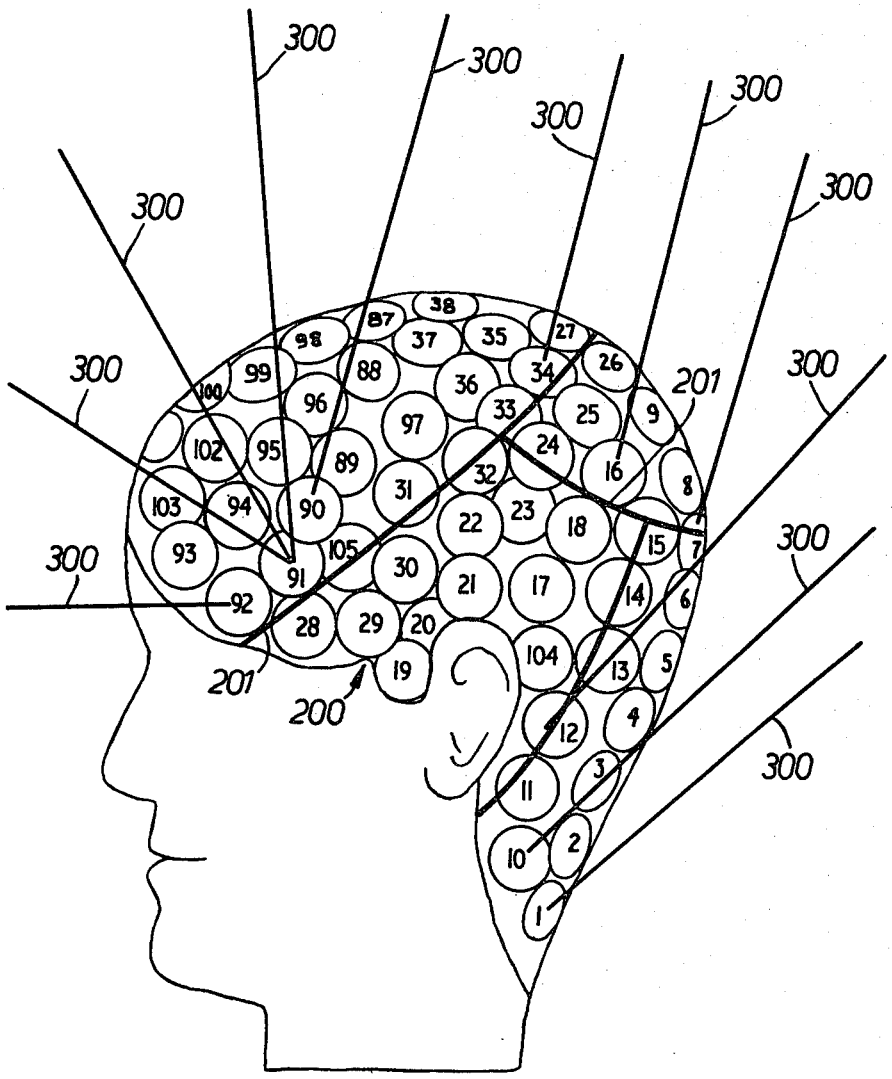
FIG. 1 is a side view of an aid for hairdressers comprising a set of sheets attached to a model scalp.

Referring first to FIG. 1 there is shown a model head including a scalp generally designated 200 on which circular areas designated by respective numerals are indicated. Attached to the model scalp are a plurality of sheets 300 each being of the general form shown in FIG. 2 but differing in dimensions as will be described later.

Each sheet 300 has at one edge a series of slits 301 cut into the edge defining a series of tabs 302 along the edge of the strip. Each end tab carries a circular disk 303 made of Velcro (registered trade mark).

The circular areas of the scalp 200 are covered in a material to which Velcro (registered trade mark) will adhere and a sheet 300 is attached to the scalp by bending the tabs 302 along a line 304 out of the plane of the rest of the sheet 300 and then fixing the discs 303 to the scalp at selected places. It will be appreciated that the curve of the line 304 corresponds to the curve of the part of the scalp over which the sheet 330 is fixed. With the sheet attached the tabs 302 lie over the surface of the scalp and the rest of the sheet extends away from the scalp.

Figure 2:
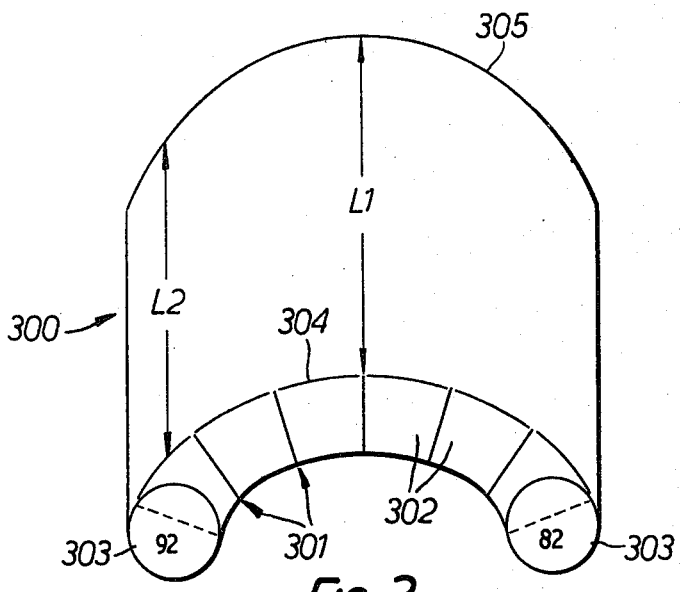
FIG. 2 is a plan view of a sheet.

The discs 303 are each numbered with characteristic numbers indicating where on the scalp they are to be attached. For example the discs 303 in FIG. 2 are numbered as 92 and 82 indicating that they should be attached to the areas of the scalp numbered as 92 and 82 respectively (area 82 is on the opposite side of the scalp and is not shown in FIG. 1).

For each sheet 300 opposite the tabs 302 is a free edge 305 which defines the line along which hair is to be cut. Each sheet 300 has a respective characteristic free edge 305 at a respective distance from the line 304.

The free edge 305 indicates to a hairdresser the length to which hair rooted in the vicinity of the base of the sheet on the model scalp should be cut. For example, in the case of the sheet shown in FIG. 2, hair rooted in the vicinity of the centre of the sheet should be cut to a length L1 while hair rooted in the vicinity of the area 92 should be cut to a length L2.

In order to use the model scalp to show a hairdresser how to cut hair to a particular style a set of sheets 300 for that style is taken and attached to the numbered areas of the scalp according to the numbers of the discs 303 on the sheets. The hairdresser then takes a tuft of hair (of a person's head or of a dummy's head) lying approximately along the line of a particular sheet and holding the hair away from the scalp in a conventional manner between his fingers cuts the hair along a line of the same shape and at the same distance from the scalp as the free edge 305 of the particular sheet. This action is then repeated for each sheet until substantially all the hair has been cut, whereupon the hair will have been cut to the preselected style determined by the shape and positioning of the sheets.

From the description above it will be apparent that one set of sheets 300 provides complete instruction to a hairdresser as to how to cut hair to one particular style. Although in FIG. 1 for the sake of clarity all the sheets 300 are shown as lying in planes across the person's head and centred on their head, it should be understood that at least for most styles there will also be sheets at the sides of the scalp which may be on one side only of the head and may lie in planes running from the back to the front of the persons head. For example, one sheet 300 might be fixed between the areas marked 28 and 11 in FIG. 1 (this would be designated by numbering the discs 303 of the sheet as 28 and 11 respectively).

In order to expedite matching of the numbers on the discs 303 to the numbered areas of the scalp 200, the scalp 200 may be divided into different regions designated by different colours. FIG. 1 shows imaginary boundary lines 201 dividing the scalp into separate regions each of which may be coloured a characteristic colour. Sheets 300 may then be coloured according to the region of the scalp in which they are to be fixed. In this way a user can tell immediately from the colour of a sheet to which area of the scalp the sheet is to be fixed and has then only to look within that region for a particular numbered area.

Figure 3:
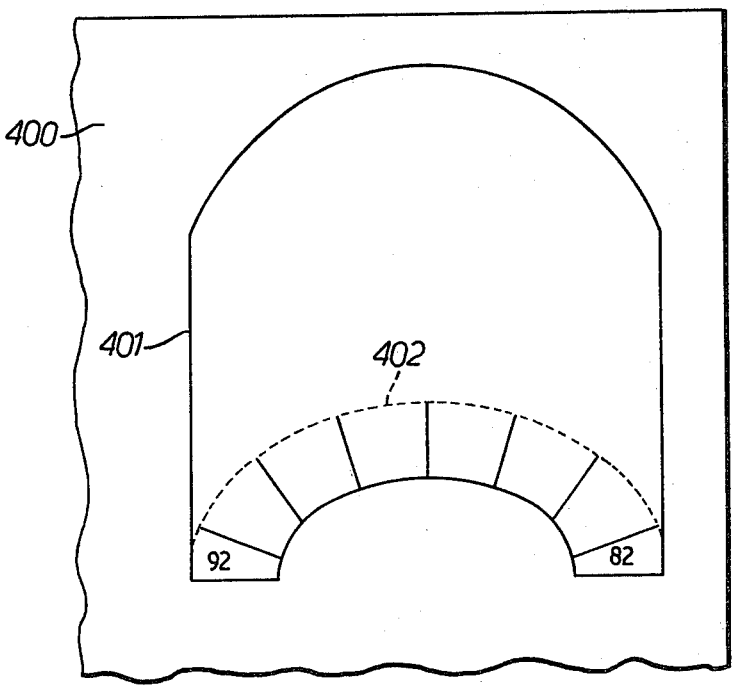
FIG. 3 is a plan view of a part of the blank from which the sheet of FIG. 2 can be made.

For each hair style a different set of sheets 300 are provided. Conveniently the sheets may be provided in the form of blanks with lines printed thereon showing where they should be cut. FIG. 3 shows part of a blank 400 from which the sheet 300 may be cut. Solid lines 401 ruled on the blank indicate where the blank should be cut while the dotted line 402 shows the line along which the tabs 302 are folded. One blank 400 may contain several sheets 300 or even an entire set of sheets 300. The discs 303 can be stuck to the sheets 300 after they have been cut out of the blank.

A large number of hair styles can be taught to hairdressers in different salons by providing each salon with a model scalp and then a set of printed blanks for each hair style. The salon can cut out the blanks to make up sets of sheets. As new hair styles are introduced further sets of blanks can be sent to the salons.

The use of Velcro (registered trade mark) discs 303 is convenient but many other methods of fixing the sheets to the scalp may be used. For example the sheets may be stuck to the scalp with adhesive or may be pinned to the scalp.

Instead of marking areas of the scalp with numbers, the scalp may be divided up into a grid and the numbers on the discs 303 of the sheets 300 may be grid references. Other ways of indicating the location of the sheets on the scalp will be apparent to those skilled in the art. One alternative method would be to indicate the location of one end only of the edge of the sheet but also indicate the orientation of the sheet on the scalp. Alternatively the sheet might include a pictorial representation showing where on the scalp it should be attached and in this case no marking on the scalp would be necessary.

Each sheet 300 may have printed thereon perming or setting instructions applicable to the hair to which the sheet relates.

While the use of relatively stiff card for the sheets 300 is preferred so that the sheets are freestanding and a hairdresser can see at a glance how all the hair should be cut, it is possible to make the sheets 300 of floppy material so that they normally lie over the surface of the scalp and are lifted up when the hairdresser wishes to see how to cut hair in a particular region.

The members 300 are referred to herein as "sheets" and this term is used in view of the lamellar shape of the members. It does not, for example, imply any particular material form which the members may be made.

What is claimed is:

1. An aid for hairdressers comprising:

a model scalp, a set of sheets, each for attachment along one edge to the scalp, and means indicating the location on the scalp at which each sheet is to be attached, wherein each sheet, when correctly attached to the scalp, has a free edge opposite the edge attached to the scalp showing the line along which hair should be cut.

2. An aid according to claim 1 wherein a plurality of sets of sheets are provided.

3. An aid according to claim 1 wherein the sheets are provided in blank form to be cut out along lines indicated on the blank.

4. An aid according to claim 1 wherein the indicating means includes markings on the sheets indicating where on the scalp the sheets are to be located.

5. An aid according to claim 4 wherein the scalp is marked to facilitate indication of the location of the sheets.

6. An aid according to claim 5 wherein the indicating means comprises a multiplicity of indices designating respective areas of the scalp and information on each sheet indicating over which areas of the scalp said one edge of the respective sheet should be attached.

7. An aid according to claim 6 wherein the information consists of a respective index at each end of the edge of the sheet corresponding to a particular index on the scalp at which the respective end of the sheet is to be attached.

8. An aid according to claim 7 wherein the indices are numbers.

9. An aid according to claim 7 or 8 wherein different areas of the scalp are differently coloured and the sheets are coloured to correspond to the area of the scalp to which they are to be fixed.

10. An aid according to claim 1 wherein the sheets are made of such a stiffness that they project outwardly from the scalp.

11. An aid according to claim 1 wherein the sheets are floppy so that they lie over the surface of the scalp.

* * * * *